US005791922A

United States Patent [19]

Takata et al.

[11] Patent Number: 5,791,922

[45] Date of Patent: Aug. 11, 1998

[54] ELECTRIC CONNECTOR ASSEMBLY

[75] Inventors: Kensaku Takata; Satoshi Tasano, both of Osaka; Hitoshi Okumura, Yokkaichi; Masaji Suzuki, Yokkaichi; Mitsuru Itou, Yokkaichi, all of Japan

[73] Assignees: Sumitomo Electric Industries, Ltd., Osaka; Sumitomo Wiring Systems, Ltd., Mie, both of Japan

[21] Appl. No.: 702,165

[22] Filed: Aug. 23, 1996

[30] Foreign Application Priority Data

Aug. 25, 1995 [JP] Japan ..... 7-217682

[51] Int. Cl.[6] ..... H01R 29/00

[52] U.S. Cl. ..... 439/188

[58] Field of Search ..... 439/188, 489, 439/490

[56] References Cited

U.S. PATENT DOCUMENTS

| | | | |
|---|---|---|---|
| 4,152,041 | 5/1979 | Hollyday et al. . | |
| 4,850,888 | 7/1989 | Denlinger et al. | 439/188 |
| 4,978,311 | 12/1990 | Oda et al. | 438/188 |
| 5,263,872 | 11/1993 | Marpoe, Jr. et al. | 438/188 |

FOREIGN PATENT DOCUMENTS

| | | |
|---|---|---|
| 60-232674 | 11/1985 | Japan . |
| 3-29896 | 6/1991 | Japan . |

*Primary Examiner*—Khiem Nguyen
*Assistant Examiner*—Eugene G. Byrd
*Attorney, Agent, or Firm*—Wenderoth, Lind & Ponack, L.L.P.

[57] ABSTRACT

A connector assembly including a first connector having female terminals which are short-circuited through a short-circuiting terminal while the first connector is not connected to a second one. When the second connector is plugged into the first connector, an insulating piece of the second connector breaks the short-circuit connection between the female terminals. The short-circuiting terminal has contact portions. At least one of the short-circuiting terminal contact portions has a side extension. The second connector has a rib adapted to press the contact portions to form a gap between the short-circuiting terminals and the female terminals. The insulating piece is inserted between the gap thus formed, so that it encounters practically no resistance. Accordingly, it is possible to reduce the thickness of the insulating piece and thus to improve the long-term reliability of the connector assembly.

8 Claims, 3 Drawing Sheets

ELECTRIC CONNECTOR ASSEMBLY

BACKGROUND OF THE INVENTION

This invention relates to a plug-in electric connector assembly including a first connector having terminals connected to a load and a means for keeping the terminals short-circuited while the first connector is not connected to the second one to prevent electrostatic failure of IC's and erroneous explosion of a detonating circuit for an air bag and to break the short-circuit connection when the first and second connectors are connected together.

Conventional connector assemblies of this type are disclosed in Unexamined Japanese Patent Publication 60-232674 and Examined Japanese Utility Model Publication 3-29896.

These connectors have a first connector having connector terminals connected to a load through signal wires and a short-circuiting terminal pressed against the connector terminals for short-circuiting the connector terminals while the first connector is not connected to the second one. Since the connector terminals are short-circuited, their potentials are kept equal. The second connector has an insulating piece adapted to be inserted between the connector terminals and the short-circuiting terminal of the first connector when the second connector is plugged into the first one to separate the short-circuiting terminal from the connector terminals, thereby breaking the short-circuit between the connector terminals.

When the insulating piece is inserted, the short-circuiting terminal is resiliently deformed. Thus, in order to minimize the stress relaxation of the short-circuiting terminal (buckling at its spring portion), the insulating piece has to be as thin as possible.

But since the insulating piece is directly pressed against the short-circuiting terminal to deform and separate it from the connector terminals, it will easily break or chip if it is not sufficiently thick.

The insulating piece disclosed in either of the above-mentioned publications is provided with a guide taper to reduce the resistance when it is inserted. But still, it is impossible to sufficiently reduce the possibility of breakage or chipping of the insulating piece.

An object of this invention is to improve the long-term reliability of a connector assembly by providing a means which makes it possible to reduce the thickness of the insulating piece without increasing the possibility of breakage and chipping.

SUMMARY OF THE INVENTION

According to this invention, there is provided a connector assembly comprising a first connector having a housing, a pair of connector terminals provided in the housing, and a short-circuiting terminal pressed against the pair of connector terminals for short-circuiting the pair of connector terminals, and a second connector adapted to be plugged in the first connector and having an insulating piece adapted to be inserted between at least one of the pair of connector terminals and the short-circuiting terminal to break the short-circuiting between the pair of connector terminals when the first and second connectors are connected together, characterized in that the short-circuiting terminal has an extension protruding to one side of at least one of the connector terminals, and that the second connector is provided with a rib adapted to press and deform the extension of the short-circuiting terminal when the second connector is inserted into the first connector, to separate the short-circuiting terminal from the connector terminals.

The short-circuiting terminal is separated from the terminals of the first connector by a sufficiently thick and strong rib. The insulating piece itself encounters no significant resistance when inserted. It is thus possible to use a sufficiently thin insulating piece.

Other features and objects of the present invention will become apparent from the following description made with reference to the accompanying drawings, in which:

DETAILED DESCRIPTION OF THE PREFERRED EMBODIMENT

Figure 1A:
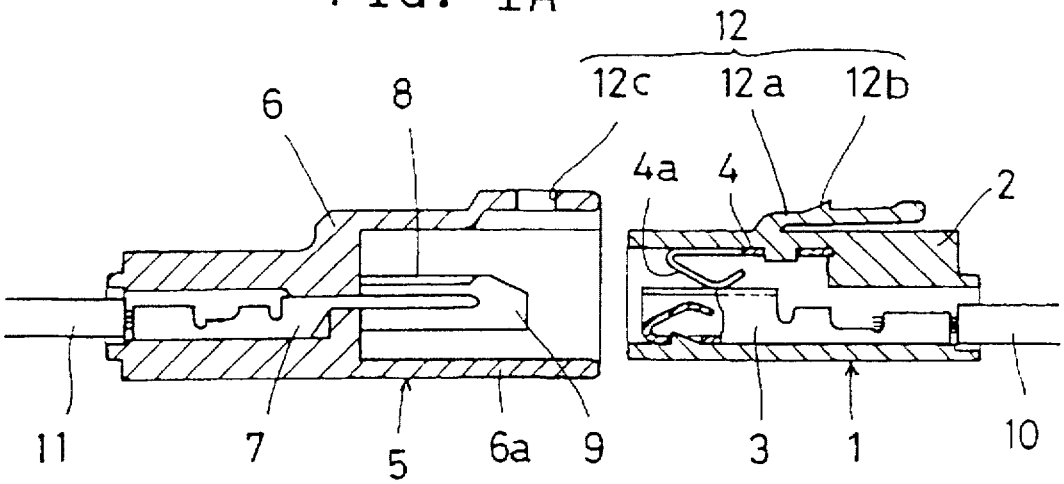
FIG. 1A is a vertical sectional view of the connector assembly embodying this invention.

FIG. 1 shows the connector assembly embodying this invention. As shown in FIG. 1A, it comprises a first connector 1 and a second connector 5 into which the first connector can be plugged.

The first connector 1 has a housing 2 in which are mounted a pair of female terminals 3 connected to signal wires 10 connected to a load, and a short-circuit terminal 4 for short-circuiting the female terminals 3.

The second connector 5 has a housing 6 in which are mounted a pair of male terminals 7 corresponding to the female terminals 3 of the first connector 1 and connected to signal wires 11 connected to a power source. An insulating piece 8 and a rib 9 are received in a hood **6*a* of the housing 6 in which the housing 2 of the first connector 1** is inserted.

This connector assembly may be optionally provided with a simple locking mechanism 12 for keeping the connectors locked in position. It comprises e.g. a resilient arm **12*a* having a barb 12*b* adapted to engage in a recess 12*c***.

Figure 1B:
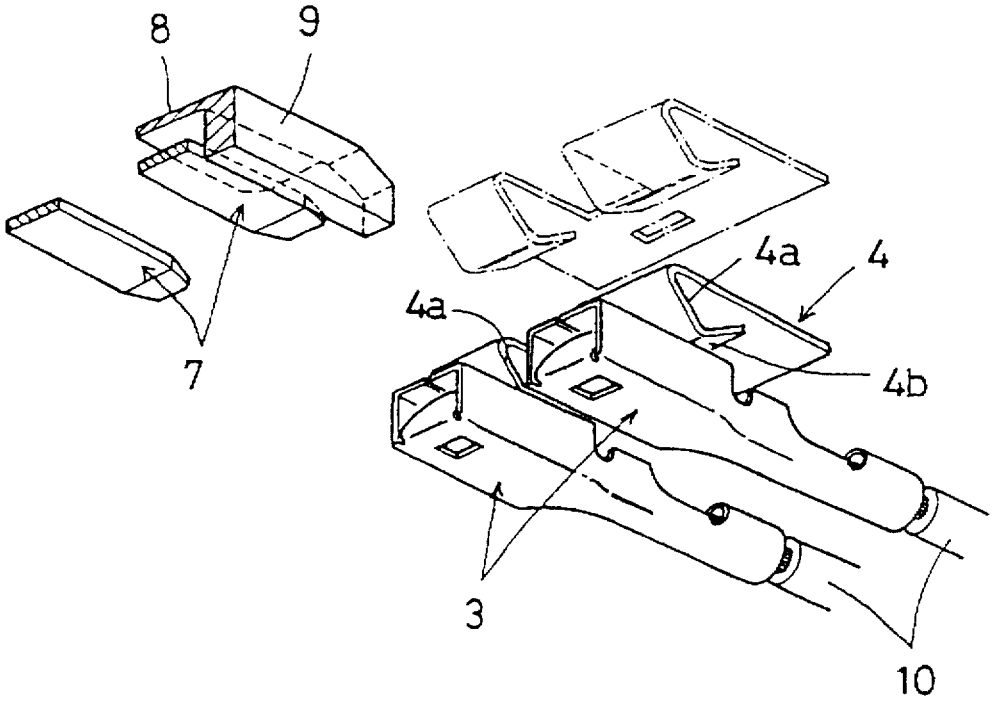
FIG. 1B is a perspective view of the connector assembly of FIG. 1A showing its inner structure.

As shown in FIG. 1B, the short-circuiting terminal 4 has two contact portions **4*a* formed by bending. When the two connectors are not connected together, the contact portions 4*a* are pressed in the housing 2 against the female terminals 3 in a resiliently deformed state, so that the female terminals 3 are short-circuited through the short-circuiting terminal 4**.

One of the contact portions **4*a* has an extension 4*b* protruding sideways from one of the female terminals 3. The rib 9 is provided at a position opposite to the extension 4*b* and has a tapered guide surface at its front end. The front end of the insulating piece 8 is located near the rear end of the tapered guide surface. The insulating piece 8 is adapted to be inserted between the female terminals 3 and the contact portions 4*a* of the short-circuiting terminal 4**.

Figure 2A:
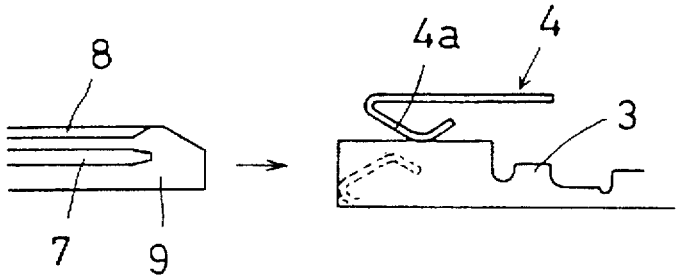
FIG. 2A–2C show how the rib is inserted.
Figure 2B:
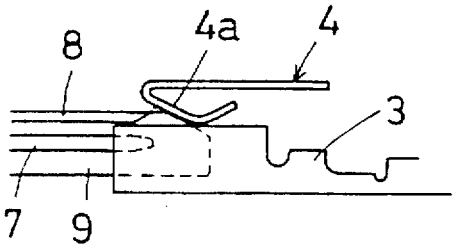
Figure 2C:
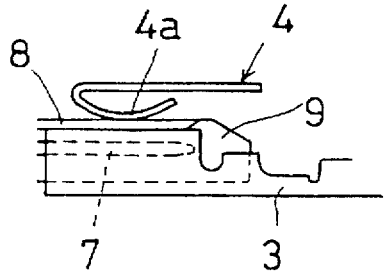

When the first connector 1 is pushed into the second connector 5, the rib 9 is inserted into the space on the outer side of one of the female terminals 3. Preferably, the male terminals 7 are positioned so that their tips are slightly inserted in the female terminals 3 when the tapered guide surface of the rib 9 abuts the contact portion **4*a* as shown in FIG. 2B. By further pushing in the second connector 5 into the first connector 1 from the state of FIG. 2B, the rib 9 advances while gradually deforming the contact portion 4***a* to create a gap between the contact portion 4*a* and the female terminal 3, so that the insulating piece 8, which follows the rib 9, can be smoothly inserted into the gap thus formed without encountering any major resistance.

Thus, high strength material is not needed for the insulating piece 8, so that it is possible to reduce the fatigue of the contact portion 4*a* by using a thin insulating piece 8. The insulating piece 8 as shown in FIG. 1, which can insulate only one of the female terminals 3 from the short-circuiting terminal 4, would be sufficient. But instead, an insulating piece which can insulate both female terminals from the short-circuiting terminal may be used.

Preferably, the insulating piece 8 and the rib 9 are formed as an integral member as shown. Forming the rib 9 integrally with the insulating piece 8 serves to reinforce the insulating piece 8, thus making it possible to further reduce its thickness.

Figure 3:
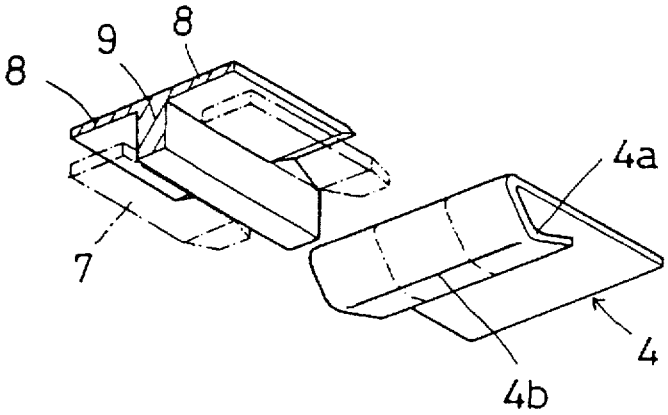
FIG. 3 is a perspective view of a rib provided between the pair of connector terminals.

In order to reduce the width of the entire connector assembly, the extension 4*b* may be provided, not on the outer side of one of the contact portions 4*a* as shown in FIG. 1, but on its inner side, i.e. between the female terminals 3. In this case, as shown in FIG. 3, two insulating pieces 8 reinforced with a single rib 9 may be used.

Also, ribs 9 and extensions 4*b* may be provided on both sides of the female terminals 3 to improve the balance of pressure by the contact portions 4*a* and to more stably reinforce the insulating pieces 8 with the ribs.

Figure 4A:
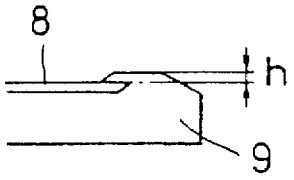
FIG. 4A is a side view of a rib having a step protruding from the insulating piece.
Figure 4B:
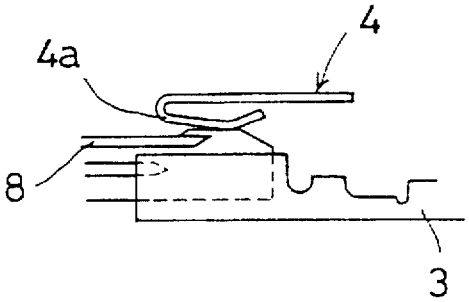
FIGS. 4B and 4C show how the rib is inserted.

It is also preferable to provide a step h as shown in FIG. 4. By providing the step, the contact portions 4*a* are deformed by a distance equal to the sum of the thickness of the insulating piece 8 and the height of the step h, whereas in the arrangement of FIG. 1, having no such step, the contact portions 4*a* are deformed only by a distance equal to the thickness of the insulating piece 8. Thus, in the arrangement of FIG. 4, it is possible to prevent the insulating piece 8 from coming into contact with the contact portions 4*a* when the insulating piece is inserted.

Figure 4C:
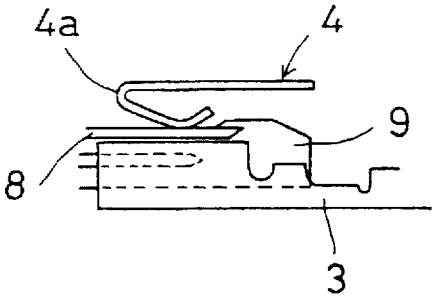

The contact portion 4*a* is deformed to the maximum by step h only while the insulating piece 8 is being inserted. Once the insulating piece 8 is fully inserted, the contact portion 4*a* clears the step h and is pressed against the thin insulating piece 8 as shown in FIG. 4C.

According to this invention, the rib provided on the second connector presses and deforms the short-circuiting terminal, forming a gap between the connector terminals and the short-circuiting terminal. The insulating piece is then inserted into the gap thus formed, encountering practically no resistance. It is thus possible to use a sufficiently thin insulating piece. Such a thin insulating piece can retard stress relaxation at the spring portion of the short-circuiting terminal, thus improving the long-term reliability of the connector assembly.

What is claimed is:

1. A connector assembly comprising:

a first connector having a housing, a pair of first connector terminals provided in said housing, and a short-circuiting terminal mounted in said housing, said short-circuiting terminal including an extension projecting beyond one side of at least one of said first connector terminals, wherein said short-circuiting is pressed against said first connector terminals in order to short-circuit said first connector terminals; and a second connector adapted to be inserted into said first connector, said second connector having a second connector terminal and an insulating piece adapted to be inserted between said short-circuiting terminal and at least one of said first connector terminals so as to break the short circuiting between said first connector terminals when said first and second connectors are connected together, said second connector being provided with a rib adapted to engage and push up said short-circuiting terminal extension so as to separate said short-circuiting terminal from said first connector terminals when said second connector is inserted into said first connector, wherein said rib engages said short-circuiting terminal before said insulating piece is inserted between said short-circuiting terminal and at least one of said first connector terminals, and said insulating piece has a top surface disposed at a level which is at or below a top surface of said rib.

2. The connector assembly as claimed in claim 1, wherein said insulating piece is integral with said rib.

3. The connector assembly as claimed in claim 1, wherein said top surface of said insulating piece is disposed below said top surface of said rib.

4. The connector assembly as claimed in claim 1, wherein said rib has a leading end portion which is tapered so as to form a tapered guide portion, and said insulating piece has a leading end portion disposed near a rear end of said tapered guide portion.

5. The connector assembly as claimed in claim 1, wherein said rib has a tip portion which protrudes ahead of a leading end of said insulating piece in an insertion direction of said second connector into said first connector.

6. The connector assembly as claimed in claim 5, wherein said insulating piece is integral with said rib.

7. The connector assembly as claimed in claim 5, wherein said top surface of said insulating piece is disposed below said top surface of said rib.

8. The connector assembly as claimed in claim 5, wherein said rib has a leading end portion which is tapered so as to form a tapered guide portion, and said insulating piece has a leading end portion disposed near a rear end of said tapered guide portion.

* * * * *